US007257881B1

(12) United States Patent
Martin et al.

(10) Patent No.: US 7,257,881 B1
(45) Date of Patent: Aug. 21, 2007

(54) METHOD AND STRUCTURE FOR ASSEMBLING ELECTRICAL WINDINGS ABOUT A CENTRAL MEMBER

(75) Inventors: Arthur Ray Martin, Rowlett, TX (US); Roger Dale Grandchampt, Dallas, TX (US)

(73) Assignee: Tyco Electronics Power Systems, Inc., Mesquite, TX (US)

( * ) Notice: Subject to any disclaimer, the term of this patent is extended or adjusted under 35 U.S.C. 154(b) by 0 days.

(21) Appl. No.: 11/542,306

(22) Filed: Oct. 2, 2006

(51) Int. Cl.
*H01F 7/06* (2006.01)
*H01F 27/28* (2006.01)
*B65H 39/16* (2006.01)

(52) U.S. Cl. ..... 29/605; 29/596; 29/598; 29/606; 29/609; 242/444.1; 336/182

(58) Field of Classification Search ..... 29/605, 29/606, 596, 598, 609, 628; 336/182, 188, 336/185, 186; 242/444.1, 444.2, 444.4, 444.5; 310/184, 179, 254, 217, 156, 218
See application file for complete search history.

(56) References Cited

U.S. PATENT DOCUMENTS 4,401,495 A * 8/1983 McKinney ..... 156/173
4,847,583 A * 7/1989 Bernard ..... 336/84 C
5,227,755 A * 7/1993 Westphal et al. ..... 335/216
5,831,506 A * 11/1998 Crepel ..... 336/187

* cited by examiner

*Primary Examiner*—A. Dexter Tugbang
*Assistant Examiner*—Tai Van Nguyen
(74) *Attorney, Agent, or Firm*—Law Office of Donald D. Mondul

(57) ABSTRACT

A method for assembling electrical windings about an axis, the windings being strips and wound in alternating strata with their widths parallel with the axis, includes the steps: (a) Winding a first-wound winding in a winding path about the axis establishing a first stratum. (b) Arranging the first-wound winding to clear the winding path. (c) Winding one or more next windings to establish next-wound windings in the winding path until at least one next stratum is established. (d) Interleaving earlier-wound windings to establish the plurality of strata; the interleaving including the steps of: (1) rearranging a next-to-be-wound winding to realign with the winding path; (2) winding the next-to-be-wound winding in the winding path until a next stratum is established; (3) arranging the next-to-be-wound winding to clear the winding path; and (4) repeating steps (d)(1) through (d)(3) until the assembling is complete.

16 Claims, 10 Drawing Sheets

METHOD AND STRUCTURE FOR ASSEMBLING ELECTRICAL WINDINGS ABOUT A CENTRAL MEMBER

BACKGROUND OF THE INVENTION

The present invention is directed to electrical winding structures that may be employed in electromagnetic devices such as, by way of example and not by way of limitation, transformers, relays, solenoids and similar devices.

Prior art electromagnetic devices employ discrete structures for each winding stratum about a central member. The central member may be embodied in a ferrous core, another type of magnetic core, an air core or a mandrel used solely to effect a winding operation. For example, if one wished to provide a device with a primary winding and a secondary winding, each of the primary and secondary windings would be a discrete winding structure unconnected with the other. Such an arrangement is not a problem in a simple winding structure. However, it may be advantageous to employ a more complex winding structure that requires interleaving or otherwise alternating segments of a primary winding and a secondary winding. The effect may result in an A-B-A-B arrangement of windings where A-layers may be a primary winding and B-layers may be a secondary winding. Providing electrical access, such as by connecting termination structures or leads to alternating layers situated in the interior of the winding structure is problematic. The problems associated with such a structure generally result in more difficult manufacture, manual assembly and less stringent operating limits. Such characteristics generally result in a more expensive looser-tolerance product. Individual electrical leads provided for each layer of a respective winding (primary winding or secondary winding) at each interleaved or alternated stratum present can present a virtual "forest" of multiple leads for effecting proper connection of the unit within a host device. Such multiple connection leads present their own problems and attendant costs in effecting assembly of a device employing such a multi-lead electromagnetic unit.

There is a need for a method and structure for assembling electrical windings about a central member for an electromagnetic device that does not require multiple leads for terminating with discrete layers of respective windings located within the interior of the device.

SUMMARY OF THE INVENTION

A method for assembling electrical windings about an axis, the windings being strips and wound in alternating strata with their widths parallel with the axis, includes the steps: (a) Winding a first-wound winding in a winding path about the axis establishing a first stratum. (b) Arranging the first-wound winding to clear the winding path. (c) Winding one or more next windings to establish next-wound windings in the winding path until at least one next stratum is established. (d) Interleaving earlier-wound windings to establish the plurality of strata; the interleaving including the steps of: (1) rearranging a next-to-be-wound winding to realign with the winding path; (2) winding the next-to-be-wound winding in the winding path until a next stratum is established; (3) arranging the next-to-be-wound winding to clear the winding path; and (4) repeating steps (d)(1) through (d)(3) until the assembling is complete.

An electrical winding structure configured for use in assembling a plurality of electrical winding structures in an installed orientation wound about a central member includes: a unitary segmented strip. First portions of the unitary strip are oriented about a first axis. Second portions of the unitary strip are oriented about a second axis substantially perpendicular with the first axis. Each of the first portions and the second portions have a thickness, have a width greater than the thickness and have a length at least as great as the width. The first and second portions are oriented to effect arranging the electrical winding structure at predetermined loci during winding to clear the winding path to establish a predetermined plurality of strata in the installed orientation.

It is, therefore, an object of the present invention to provide a method and structure for assembling electrical windings about a central member for an electromagnetic device that does not require multiple leads for terminating with discrete layers of respective windings located within the interior of the device.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
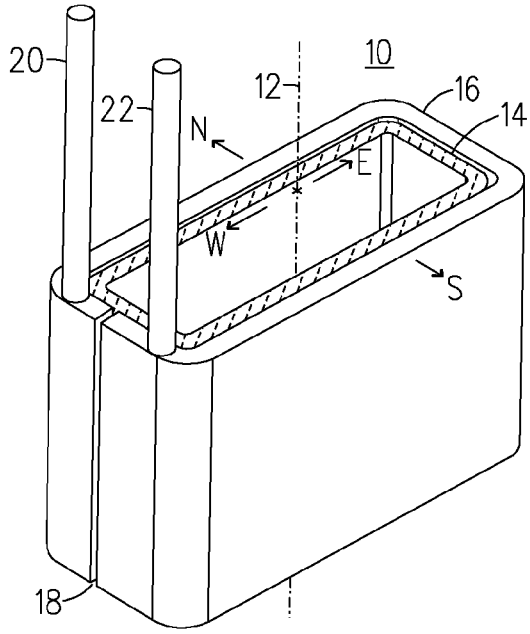
FIG. 1 (PRIOR ART)
FIG. 1 illustrates a first step in assembling an electrical winding structure using a prior art technique.

FIG. 1 illustrates a first step in assembling an electrical winding structure using a prior art technique. In FIG. 1, an electrical winding structure 10 is oriented substantially symmetrically about an axis 12. For ease of reference a plane is illustrated substantially perpendicular with axis 12 having directions "NORTH", "EAST", "SOUTH" and "WEST". Electrical winding structure 10 includes a central structure or member 14 substantially symmetrically oriented about axis 12. As may be recognized by those skilled in the art of electrical winding structures and as representatively illustrated in FIG. 1, central member 14 may be a non-ferrous form for establishing an air core for electrical winding structure 10. Alternatively, central member 14 may be a solid ferrous core member (not shown in FIG. 1) or a thin-walled ferrous member configured substantially as illustrated in FIG. 1. Another alternative embodiment of central member 14 may be a mandrel upon which electrical winding structure 10 is constructed, which mandrel is removed after completion of fabrication of electrical winding structure 10.

In FIG. 1, a first step has been effected in constructing electrical winding structure 10 by installing a first winding 16 on central member 14. First winding 16 may be configured using a strip of electrically conductive material, such as copper, gold, silver or another electrically conductive material. Preferably, the strip is electrically insulated over most or all of its surface area in order to avoid shorting between layers if more than one turn of first winding 16 is installed about central member 14. In order to simplify this description, only one turn of first winding 16 is installed about central member 14 in FIG. 1. First winding 16 is arranged to substantially surround central member 14 so that the NORTH, EAST and SOUTH sides of central member 14 are covered by first winding 16 and substantially all of the WEST side of central member 14 is covered by first winding 16. A gap 18 is provided between ends of first winding 16 to avoid electrical shorting of winding 16. Electrical leads 20, 22 are provided for electrical connection with first winding 16 from without electrical winding structure 10 after assembly is completed.

Figure 2:
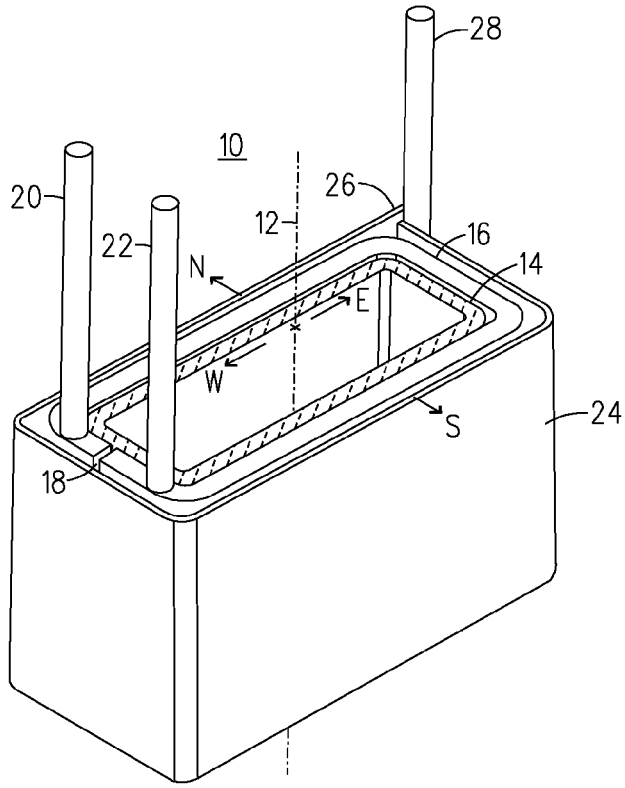
FIG. 2 (PRIOR ART)
FIG. 2 illustrates a second step in assembling the electrical winding structure illustrated in FIG. 1 using a prior art technique.

FIG. 2 illustrates a second step in assembling the electrical winding structure illustrated in FIG. 1 using a prior art technique. In FIG. 2, a second step has been effected in constructing electrical winding structure 10 by installing a second winding 24 on top of first winding 16 about central member 14. Second winding 24 may be configured similar to first winding 16 employing a strip of electrically conductive material preferably electrically insulated over most or all of its surface area in order to avoid shorting between layers if more than one turn of second winding 24 is installed. In order to simplify this description, only one turn of second winding 24 is installed on top of first winding 16 about central member 14 in FIG. 2. Second winding 24 is arranged to substantially surround first winding 16 and central member 14 so that the NORTH, EAST, SOUTH and WEST sides of first winding 16 and central member 14 are covered by second winding 24. Second winding 24 is illustrated with a remainder portion 26 poised in FIG. 2 for applying or installing a second turn. Electrical lead 28 is provided for electrical connection with second winding 24 from without electrical winding structure 10 after assembly is completed. As will be understood by those skilled in the art of electrical winding assemblies, another electrical lead (not shown in FIG. 2) would be provided at the end of second winding 24 when second winding 24 is terminated. Other windings (not shown in FIG. 2) may be applied to surround first winding 16, second winding 24 and central member 14 as desired. For purposes of phase balance, AC (Alternating Current) loss reduction and other design parameter optimization, several alternating layers may be employed in electrical winding structure 10 to establish a primary and a secondary winding arrangement about central member 14. In such a structure, each respective discrete winding layer must be provided it own discrete electrical leads for effecting electrical connection with the respective winding layer. Such a structure may present a large number of leads for termination with a printed wiring board or other substrate in a host device (not shown in FIGS. 1-2). The provision of leads and their termination for connection within a host device can be problematic and reduce efficiency in manufacture and installation of electrical winding structure 10. A result may be an increase in cost of any device employing electrical winding structure 10.

Figure 3:
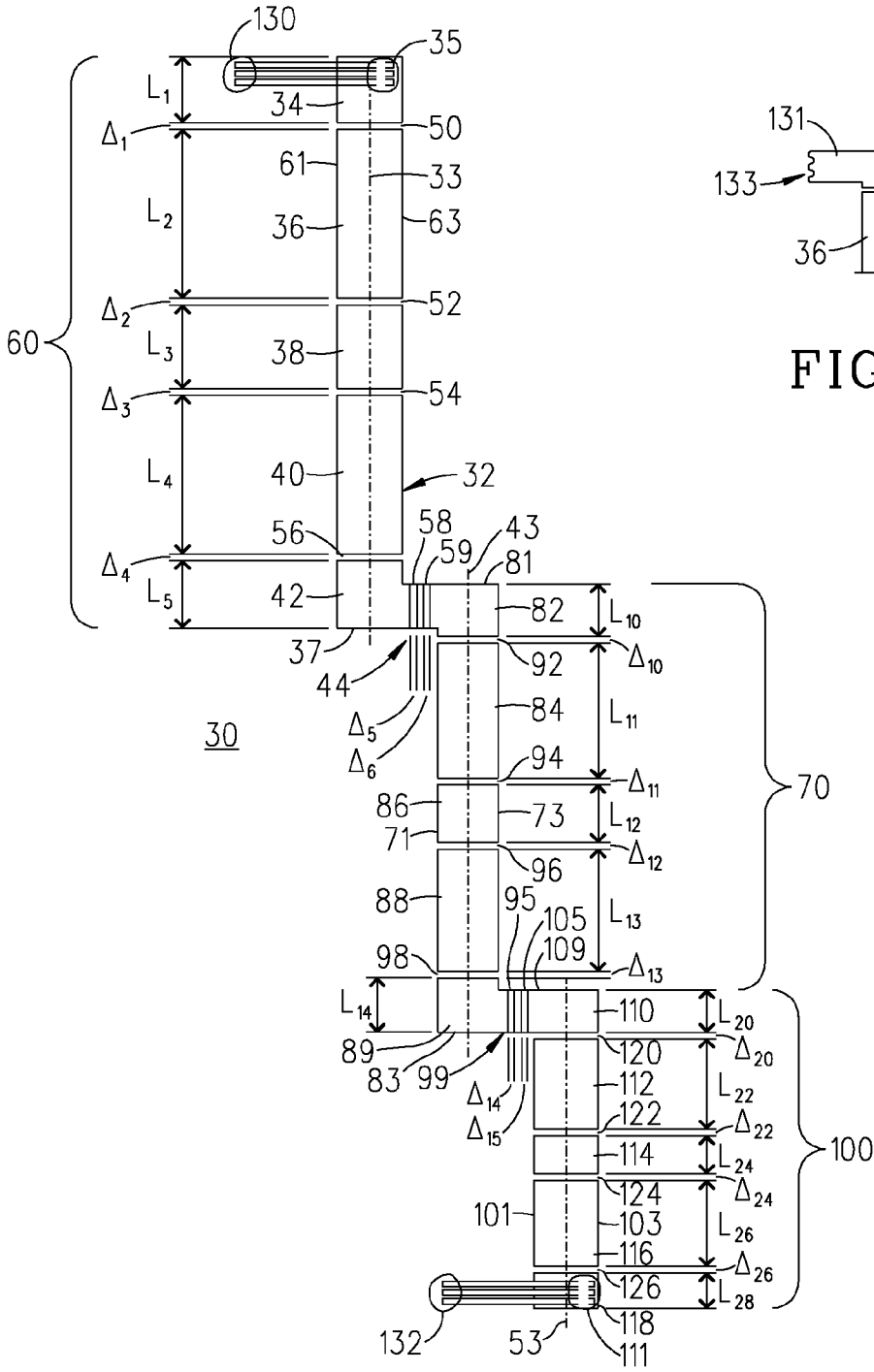
FIG. 3 is a plan view of a structure used in assembling an electrical winding structure according to a first embodiment of the present invention.

FIG. 3 is a plan view of a structure used in assembling an electrical winding structure according to a first embodiment of the present invention. In FIG. 3, an electrical winding component or structure 30 is embodied in a unitary segmented strip 32 of electrically conductive material such as copper, gold, silver or another electrically conductive material. Portions 60, 70, 100 of strip 32 include segments that are delimited by fold structures. Portion 60 of strip 32 has a first edge 61 and a second edge 63 and includes a first segment 34 extending generally symmetrically with respect to an axis 33 a length $L_1$ from an end 35 to a fold structure 50. Fold structure 50 has a length $\Delta_1$. A segment 36 extends generally symmetrically with respect to axis 33 a length $L_2$ from fold structure 50 to a fold structure 52. Fold structure 52 has a length $\Delta_2$. A segment 38 extends generally symmetrically with respect to axis 33 a length $L_3$ from fold structure 52 to a fold structure 54. Fold structure 54 has a length $\Delta_3$. A segment 40 extends generally symmetrically with respect to axis 33 a length $L_4$ from fold structure 54 to a fold structure 56. Fold structure 56 has a length $\Delta_4$. A segment 42 extends generally symmetrically with respect to axis 33 a length $L_5$ from fold structure 56 to an end 37. Lengths $L_1$, $L_2$, $L_3$, $L_4$, $L_5$, $\Delta_1$, $\Delta_2$, $\Delta_3$, $\Delta_4$ are established appropriately for providing a smooth transition as strip 32 is wound around a central member (not shown in FIG. 3; see FIGS. 4-13).

Portion 70 of strip 32 has a first edge 71 and a second edge 73 and includes a first segment 82 extending generally symmetrically with respect to an axis 43 a length $L_{10}$ from an end 81 to a fold structure 92. Fold structure 92 has a length $\Delta_{10}$. A segment 84 extends generally symmetrically with respect to axis 43 a length $L_{11}$ from fold structure 92 to a fold structure 94. Fold structure 94 has a length $\Delta_{11}$. A segment 86 extends generally symmetrically with respect to axis 43 a length $L_{12}$ from fold structure 94 to a fold structure 96. Fold structure 96 has a length $\Delta_{12}$. A segment 88 extends generally symmetrically with respect to axis 43 a length $L_{13}$ from fold structure 96 to a fold structure 98. Fold structure 98 has a length $\Delta_{13}$. A segment 89 extends generally symmetrically with respect to axis 43 a length $L_{14}$ from fold structure 98 to an end 83. Lengths $L_{10}$, $L_{11}$, $L_{12}$, $L_{13}$, $L_{14}$, $\Delta_{10}$, $\Delta_{11}$, $\Delta_{12}$, $\Delta_{13}$ are established appropriately for providing a smooth transition as strip 32 is wound around a central member (not shown in FIG. 3; see FIGS. 4-13).

Portion 100 of strip 32 has a first edge 101 and a second edge 103 and includes a first segment 110 extending generally symmetrically with respect to an axis 53 a length $L_{20}$ from an end 109 to a fold structure 120. Fold structure 120 has a length $\Delta_{20}$. A segment 112 extends generally symmetrically with respect to axis 53 a length $L_{22}$ from fold structure 120 to a fold structure 122. Fold structure 122 has a length $\Delta_{22}$. A segment 114 extends generally symmetrically with respect to axis 53 a length $L_{24}$ from fold structure 122 to a fold structure 124. Fold structure 124 has a length $\Delta_{24}$. A segment 126 extends generally symmetrically with respect to axis 53 a length $L_{26}$ from fold structure 124 to a fold structure 126. Fold structure 126 has a length $\Delta_{26}$. A segment 118 extends generally symmetrically with respect to axis 53 a length $L_{28}$ from fold structure 126 to an end 111. Lengths $L_{20}$, $L_{22}$, $L_{24}$, $L_{26}$, $L_{28}$, $\Delta_{20}$, $\Delta_{22}$, $\Delta_{24}$, $\Delta_{26}$ are established appropriately for providing a smooth transition as strip 32 is wound around a central member (not shown in FIG. 3; see FIGS. 4-13).

A transition structure 44 joins segments 42, 82. Transition structure 44 includes fold structures 58, 59. Fold structure 58 has a length $\Delta_5$. Fold structure 59 has a length $\Delta_5$. Fold structures 58, 59 and lengths $\Delta_5$, $\Delta_6$ are positioned and proportioned within transition structure 44 to accommodate a folding-straddle relationship with another wrap-layer applied in a substantially abutting relation with strip 32 in an installed orientation about a central member (not shown in FIG. 3; see FIGS. 4-13).

A transition structure 99 joins segments 89, 110. Transition structure 99 includes fold structures 95, 105. Fold structure 95 has a length $\Delta_{14}$. Fold structure 105 has a length $\Delta_{15}$. Fold structures 95, 105 and lengths $\Delta_{14}$, $\Delta_{15}$ are positioned and proportioned within transition structure 99 to accommodate a folding-straddle relationship with another wrap-layer applied in a substantially abutting relation with strip 32 in an installed orientation about a central member (not shown in FIG. 3; see FIGS. 4-13).

Electrical connection leads 130, 132 are coupled with strip 32 at segments 34, 118. Multiple leads are indicated in FIG. 3 in recognition that such multiple leads are sometimes required in order to meet current carrying requirements for an electrical winding device. Connection between leads 130, 132 and strip 32 may be established by soldering, conductive adhesive, sonic welding or another connection process or technique that preserves electrical connectivity between strip 32 and leads 103, 132.

Figure 3A:
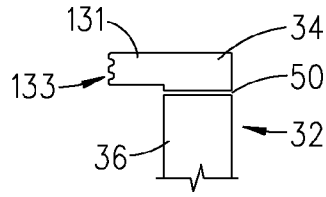
FIG. 3A is a plan view of detail of an alternate structure for terminating a winding configured using the structure described in connection with FIG. 3.

FIG. 3A is a plan view of detail of an alternate structure for terminating a winding configured using the structure described in connection with FIG. 3. In FIG. 3A, an integral uninsulated tab is formed in an end segment of strip 32 (FIG. 3). In order to avoid prolixity, only one end segment 34 will be described. One skilled in the art of electrical winding structures will recognize how one may apply the illustrated alternate embodiment in either of end segments 34, 118. In FIG. 3A, end segment 34 of strip 32 is separated from segment 36 by fold structure 50. A connection tab 131 is integrally formed in end segment 34. Connection tab 131 may be dimensioned and configured for connecting insertion with a slot in a printed wiring board or other receiving structure or substrate in a host device (not shown on FIG. 3A). A serrated edge or sawtooth edge 133 or another structure (not shown in FIG. 3A) may be provided for easing or enhancing connection of strip 32 with a host device using integral connection tab 131.

Figure 4:
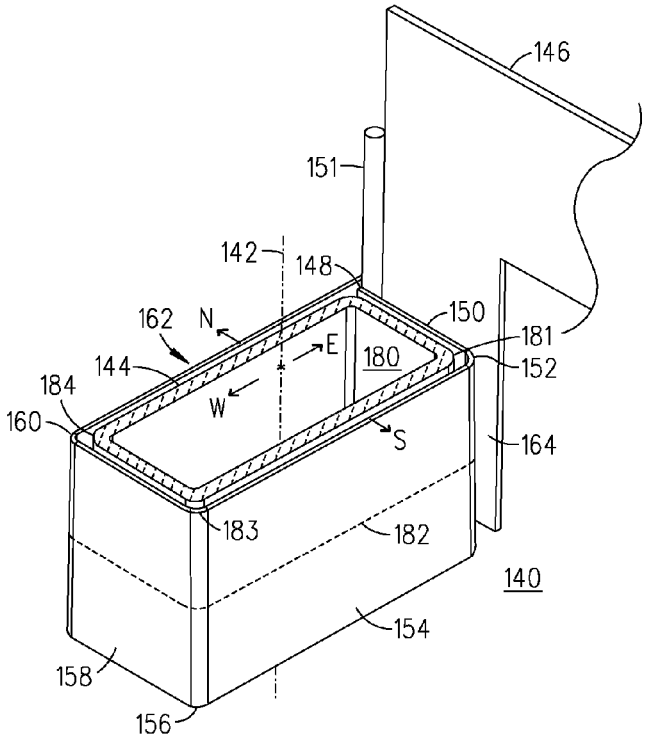
FIG. 4 illustrates a first step in assembling an electrical winding structure using the structure illustrated in FIG. 3.

FIG. 4 illustrates a first step in assembling an electrical winding structure using the structure illustrated in FIG. 3. In FIG. 4, an electrical winding structure 140 is oriented substantially symmetrically about an axis 142. For ease of reference a plane is illustrated substantially perpendicular with axis 142 having directions "NORTH", "EAST", "SOUTH" and "WEST". Electrical winding structure 140 includes a central structure or member 144 substantially symmetrically oriented about axis 142. As may be recognized by those skilled in the art of electrical winding structures and as representatively illustrated in FIG. 4, central member 144 may be a non-ferrous form for establishing an air core for electrical winding structure 140. Alternatively, central member 144 may be a solid ferrous core member (not shown in FIG. 4) or a thin-walled ferrous member configured substantially as illustrated in FIG. 4. Another alternative embodiment of central member 144 may be a mandrel upon which electrical winding structure 140 is constructed, which mandrel is removed after completion of fabrication of electrical winding structure 140.

In FIG. 4, a winding strip 146 is applied around a central member 144 along a winding path 182 for establishing windings about central member 144. Strip 146 is substantially similar with strip 32 (FIG. 3). Strip 146 has a segment 150 extending from an end 148 to a fold structure 152. Segment 150 has a length appropriate to span eastern face 180 of central member 144. Electrical lead 151 is affixed or connected with strip 146 at segment 150. Fold structure 152 is configured to have an appropriate length to accommodate curving about central member 144 at a southeast corner 181. Strip 146 has a segment 154 extending from fold structure 152 to a fold structure 156. Segment 154 has a length appropriate to span a southern face of central member 144 (obscured in FIG. 4 by strip 146). Fold structure 156 is configured to have an appropriate length to accommodate curving about central member 144 at a southwest corner 183. Strip 146 has a segment 158 extending from fold structure 156 to a fold structure 160. Segment 158 has a length appropriate to span a western face of central member 144 (obscured in FIG. 4 by strip 146). Fold structure 160 is configured to have an appropriate length to accommodate curving about central member 144 at a northwest corner 184. Strip 146 has a segment 162 extending from fold structure 160 to a fold structure obscured by electrical lead 151. Segment 162 has a length appropriate to span a northern face of central member 144 (not visible in FIG. 4). Strip 146 has a segment 164 extending to span eastern face 180. Segment 164 extends beyond central member 144 to clear strip 146 from winding path 182 so that another layer may be applied over top of strip 146. Segment 164 is illustrated in FIG. 4 as departing upward to clear winding path 182. Segment 164 could just as well depart downward.

Comparing electrical winding structure 140 with strip 146 installed with portion 100 of strip 32 (FIG. 3) one may observe a correspondence between strips 32, 146. Segment 150 substantially corresponds with segment 118 of strip 32. Similarly, there is substantial correspondence between folding structures 126, 152, segments 116, 154, folding structures 124, 156, segments 114, 158, folding structures 122, 160, segments 112, 162, and segments 110, 164. Correspondence also is substantial between folding structure 120 and the folding structure obscured by electrical lead 151 (FIG. 4).

Figure 5:
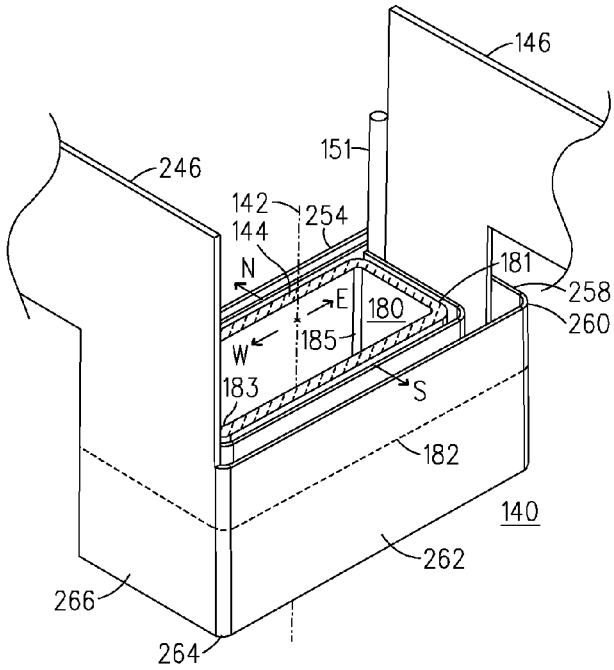
FIG. 5 illustrates a next step in assembling the electrical winding structure illustrated in FIG. 4.

FIG. 5 illustrates a next step in assembling the electrical winding structure illustrated in FIG. 4. The arrangement of central member 144, axis 142 and directions NORTH, EAST, SOUTH and WEST (Abbreviated N, E, S and W in FIGS. 5-13) is similar in FIGS. 4-13. In order to avoid prolixity description of that arrangement will not be repeated in connection with FIGS. 5-13). In FIG. 5, a winding strip 246 is applied around winding strip 146 wound about central member 144 along a winding path 182 for establishing windings about winding strip 146 wound about central member 144. Strip 246 is substantially similar with portion 100 of strip 32 (FIG. 3) and strip 146. Strip 246 has a first segment 250 (obscured in FIG. 5; partially visible in FIGS. 8-13) in substantially abutting relation with segment 158 of strip 146 (FIG. 4). Segment 250 has a length appropriate to span segment 158 (FIG. 4). An electrical lead 251 (obscured in FIG. 5; visible in FIGS. 8-13) is affixed or connected with strip 246 at segment 250. A fold structure 252 (obscured in FIG. 5; visible in FIGS. 8-13) is configured to have an appropriate length to accommodate curving about winding strip 146 wound about central member 144 at northwest corner 184. Strip 246 has a segment 254 extending from fold structure 252 to a fold structure (obscured in FIGS. 5-13). Segment 254 has a length appropriate to span the northern face of winding strip 146 wound about central member 144. Strip 246 has a segment 258 extending from the fold structure obscured at northeast corner 185 to a fold structure 260. Segment 258 has a length appropriate to span the eastern face of winding strip 146 wound about central member 144. Fold structure 260 is configured to have an appropriate length to accommodate curving about winding strip 146 wound about central member 144 at a southeast corner 181. Strip 246 has a segment 262 extending from fold structure 260 to a fold structure 264. Segment 262 has a length appropriate to span the southern face of winding strip 146 wound about central member 144. Strip 246 has a segment 266 extending to span the western face of winding strip 146 wound about central member 144. Segment 266 extends beyond strip 146 and central member 144 to clear strip 246 from winding path 182 so that another layer may be applied over top of strip 246. Segment 266 is illustrated in FIG. 5 as departing upward to clear winding path 182. Segment 266 could just as well depart downward.

Comparing strip 246 with strip 32 (FIG. 3) one may observe a correspondence between strips 32, 246 substantially similar with the correspondence between strip 146 and portion 100 of strip 32. One may observe that each succeeding winding about previous windings about central member 144 will require greater-length segments and greater-length folding structures to accommodate ever increasing widths presented for covering with each succeeding winding layer. This is manifested in strip 32 (FIG. 3) where portions 100, 70, 60 have increasingly longer lengths for corresponding segments. That is, segment length $L_5$>(is greater than) length $L_{14}$>Length $L_{28}$. Similarly, $L_4>L_{13}>L_{26}$; $L_3>L_{12}>L_{24}$; $L_2>L_{11}>L_{22}$; $L_1>L_{10}>L_{20}$. Folding structure lengths are also varied in size to accommodate greater circumferential dimensions with increasing winding layers. While not as obvious as differences n segment lengths in FIG. 3, folding structure lengths vary also so that $\Delta_4>\Delta_{13}>\Delta_{26}$; $\Delta_3>\Delta_{12}>\Delta_{24}$; $\Delta_2>\Delta_{11}>\Delta_{22}$ $\Delta_1>\Delta_{10}>\Delta_{20}$.

Figure 6:
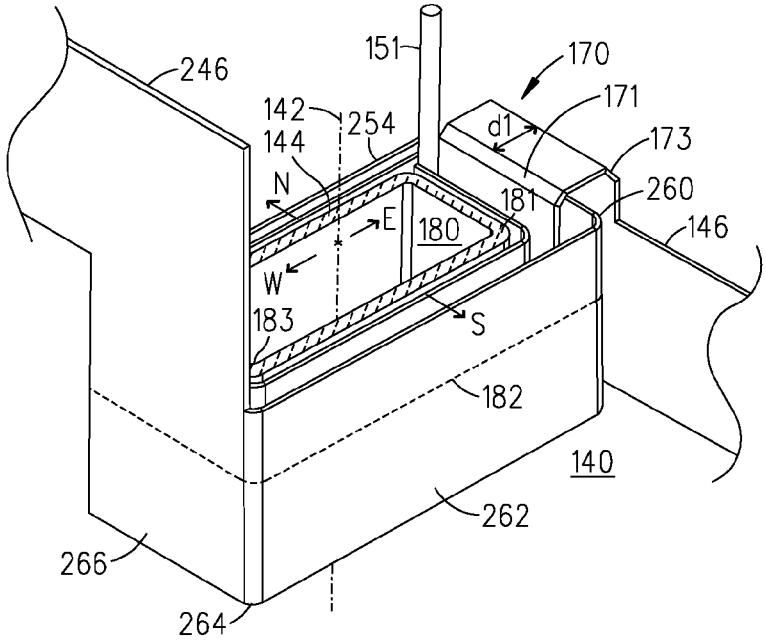
FIG. 6 illustrates a next step in assembling the electrical winding structure illustrated in FIG. 5.

FIG. 6 illustrates a next step in assembling the electrical winding structure illustrated in FIG. 5. In FIG. 6, a transition structure 170 of winding strip 146 includes folding structures 171, 173 separated by a distance $d_1$. Folding structures 171, 173 are flexed or folded to return strip 146 to winding path 182 for applying further winding using strip 146. Distance $d_1$ is of sufficient length to span one or more layers of strip 246 (one layer is illustrated in FIG. 6) and permit proper positioning of strip 146 with respect to winding path 182 for applying new windings in substantially abutting relationship with strip 246 using a new portion of strip 146 (see, e.g., portions 100, 70, 60; strip 32; FIG. 3). Winding of strip 146 about strip 246 is effected in a manner substantially as described in connection with FIGS. 4-5. One skilled in the art of electrical winding structures will recognize the similarities among FIGS. 4-6 and understand their applicability to establishing additional winding by strip 146 about strip 246. In order to avoid prolixity a detailed description will not be repeated here.

Figure 7:
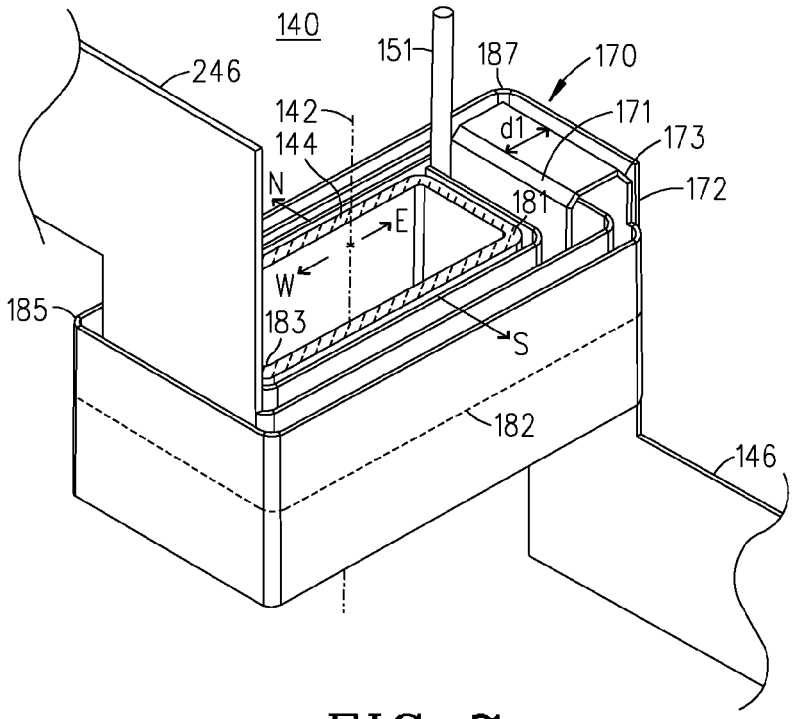
FIG. 7 illustrates a next step in assembling the electrical winding structure illustrated in FIG. 6.

FIG. 7 illustrates a next step in assembling the electrical winding structure illustrated in FIG. 6. In FIG. 7, winding strip 146 proceeds along winding path 182 from transition structure 170 substantially around electrical winding structure 140 to return to a position adjacent to transition structure 170. More than one layer of strip 146 may be applied, but only one layer is illustrated here. Layers 146, 246 and central member 144 are preferably oriented in substantially abutting relation when electrical winding structure 140 is in its assembled or installed orientation. Loose windings with gaps between layers are illustrated here to aid in understanding the invention. In its winding about strip 246, strip 146 proceeds along winding path 182 past southeast corner 181, southwest corner 183, northwest corner 185 and northeast corner 187 to return to the position illustrated in FIG. 7. One may notice that strip 146 has now (FIG. 7) established two turns about electrical winding structure 140 and electrical lead 151 is electrically coupled with the entire length of strip 146. Strip 146 is configured with a segment 172 extending beyond central member 144 to clear strip 146 from winding path 182 so that another layer may be applied over top of strip 146. Segment 172 is illustrated in FIG. 7 as departing downward to clear winding path 182. Segment 172 could just as well depart upward.

Figure 8:
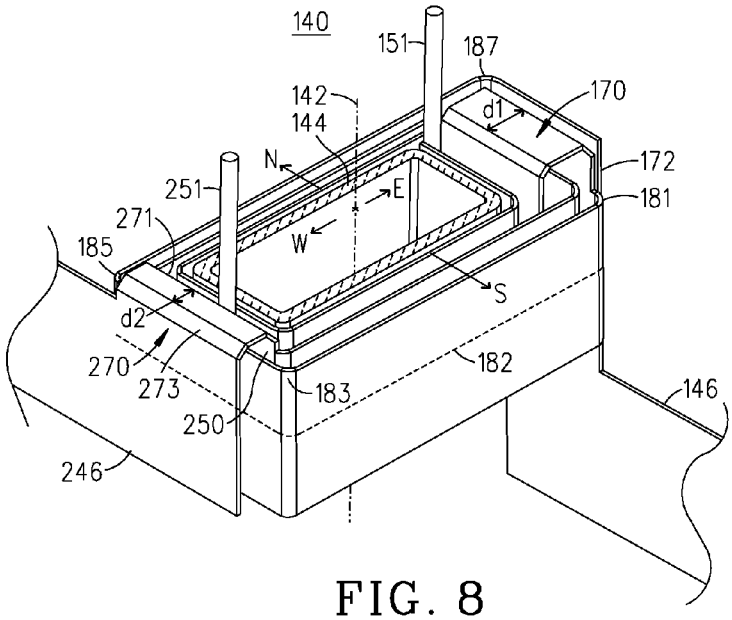
FIG. 8 illustrates a next step in assembling the electrical winding structure illustrated in FIG. 7.

FIG. 8 illustrates a next step in assembling the electrical winding structure illustrated in FIG. 7. In FIG. 8, a transition structure 270 of winding strip 246 includes folding structures 271, 273 separated by a distance $d_2$. Folding structures 271, 273 are flexed or folded to return strip 246 to winding path 182 for applying further winding using strip 246. Distance $d_2$ is of sufficient length to span one or more layers of strip 146 (one layer is illustrated in FIG. 8) and permit proper positioning of strip 246 with respect to winding path 182 for applying new windings in substantially abutting relationship with strip 146 using a new portion of strip 246 (see, e.g., portions 100, 70, 60; strip 32; FIG. 3). Winding of strip 246 about strip 146 is effected in a manner substantially as described in connection with FIGS. 4-7. One skilled in the art of electrical winding structures will recognize the similarities among FIGS. 4-7 and understand their applicability to establishing additional winding by strip 246 about strip 146. In order to avoid prolixity a detailed description will not be repeated here.

Figure 9:
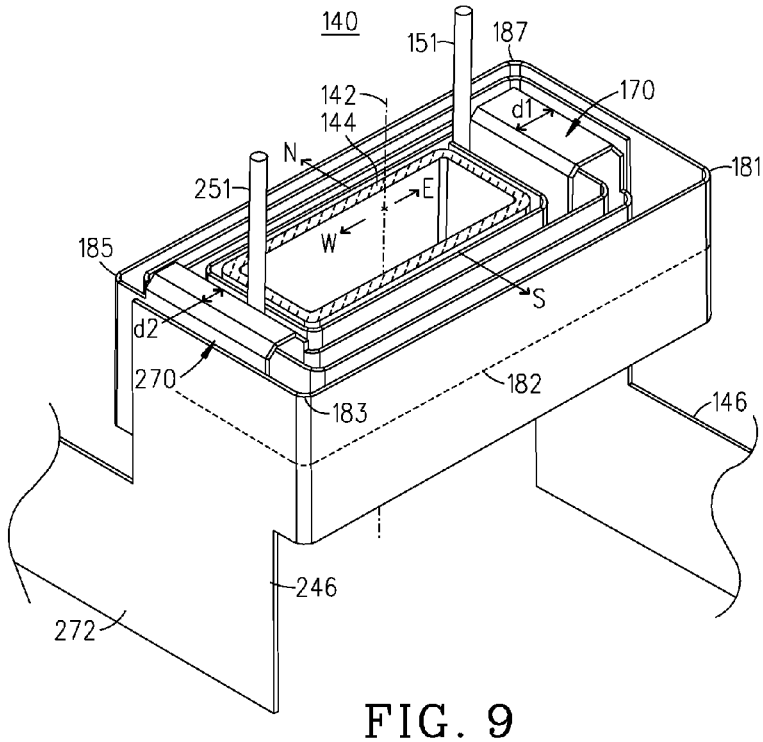
FIG. 9 illustrates a next step in assembling the electrical winding structure illustrated in FIG. 8.

FIG. 9 illustrates a next step in assembling the electrical winding structure illustrated in FIG. 8. In FIG. 9, winding strip 246 proceeds along winding path 182 from transition structure 270 substantially around electrical winding structure 140 to return to a position adjacent to transition structure 270. More than one layer of strip 246 may be applied, but only one layer is illustrated here. Layers 146, 246 and central member 144 are preferably oriented in substantially abutting relation when electrical winding structure 140 is in its assembled or installed orientation. Loose windings with gaps between layers are illustrated here to aid in understanding the invention. In its winding about strip 146, strip 246 proceeds along winding path 182 past northwest corner 185, northeast corner 187, southeast corner 181 and southwest corner 183 to return to the position illustrated in FIG. 9. One may notice that strip 246 has now (FIG. 9) established two turns about electrical winding structure 140 and electrical lead 251 is electrically coupled with the entire length of strip 246. Strip 246 is configured with a segment 272 extending beyond central member 144 to clear strip 246 from winding path 182 so that another layer may be applied over top of strip 246. Segment 272 is illustrated in FIG. 9 as departing downward to clear winding path 182. Segment 272 could just as well depart upward.

Figure 10:
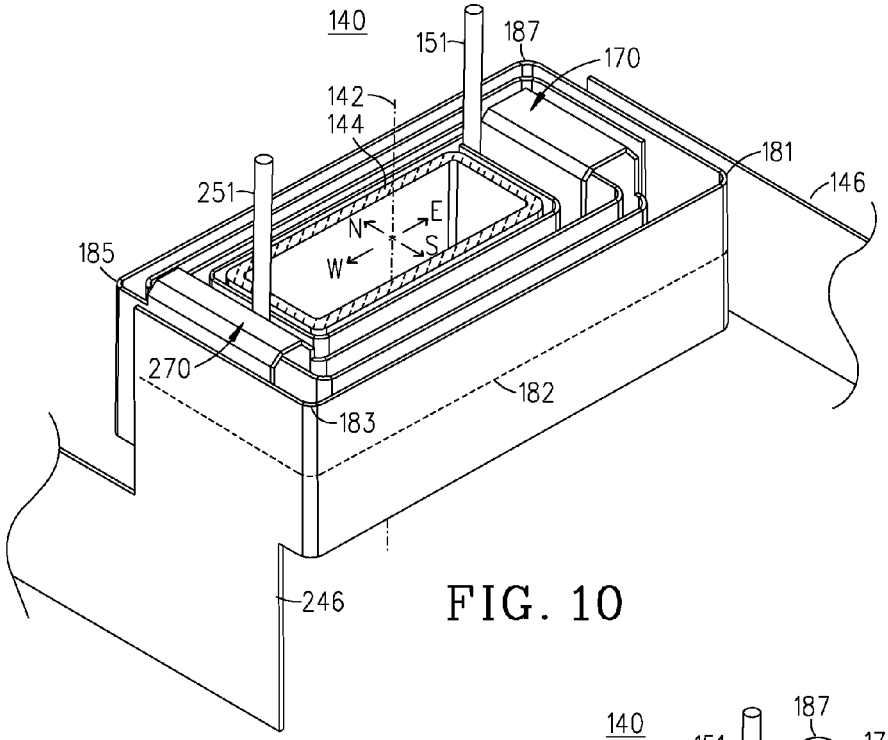
FIG. 10 illustrates a next step in assembling the electrical winding structure illustrated in FIG. 9.

FIG. 10 illustrates a next step in assembling the electrical winding structure illustrated in FIG. 9. In FIG. 10, a transition structure (not visible in FIG. 10) of winding strip 246 is configured and flexed in a manner similar to configuration and flexing of transition structure 170 (FIG. 6) to return strip 146 to span one or more layers of strip 246 (one layer is illustrated in FIG. 10) and permit proper positioning of strip 146 with respect to winding path 182 for applying new windings in substantially abutting relationship with strip 246 using a new portion of strip 146 (see, e.g., portions 100, 70, 60; strip 32; FIG. 3). Winding of strip 146 about strip 246 is effected in a manner substantially as described in connection with FIGS. 4-9. One skilled in the art of electrical winding structures will recognize the similarities among FIGS. 4-9 and understand their applicability to establishing additional winding by strip 146 about strip 246. In order to avoid prolixity a detailed description will not be repeated here.

Figure 11:
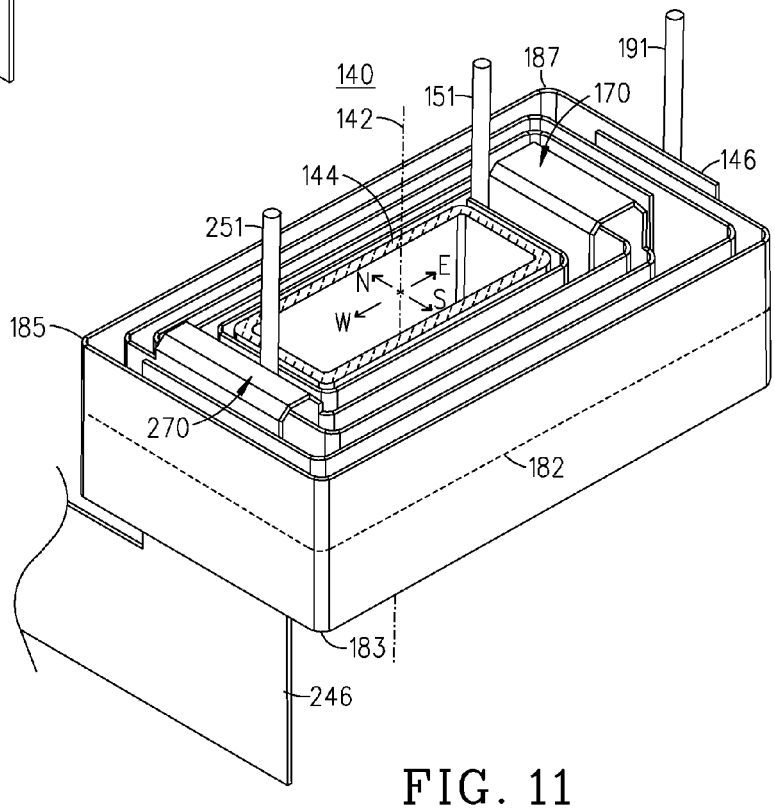
FIG. 11 illustrates a next step in assembling the electrical winding structure illustrated in FIG. 10.

FIG. 11 illustrates a next step in assembling the electrical winding structure illustrated in FIG. 10. In FIG. 11, winding strip 146 proceeds along winding path 182 substantially around electrical winding structure 140 to return to a position between corners 181, 187. More than one layer of strip 146 may be applied, but only one layer is illustrated here. Layers 146, 246 and central member 144 are preferably oriented in substantially abutting relation when electrical winding structure 140 is in its assembled or installed orientation. Loose windings with gaps between layers are illustrated here to aid in understanding the invention. In its winding about strip 246, strip 146 proceeds along winding path 182 past southeast corner 181, southwest corner 183, northwest corner 185 and northeast corner 187 to return to the position illustrated in FIG. 11. Strip 146 has now (FIG. 11) established three turns about electrical winding structure 140. An electrical lead 191 is affixed with strip 146 to establish electrical contact with strip 146. One may observe that strip 146 is electrically continuous along its entire length among various winding layers. Electrical leads 151, 191 electrically terminate each end of strip 146.

Figure 12:
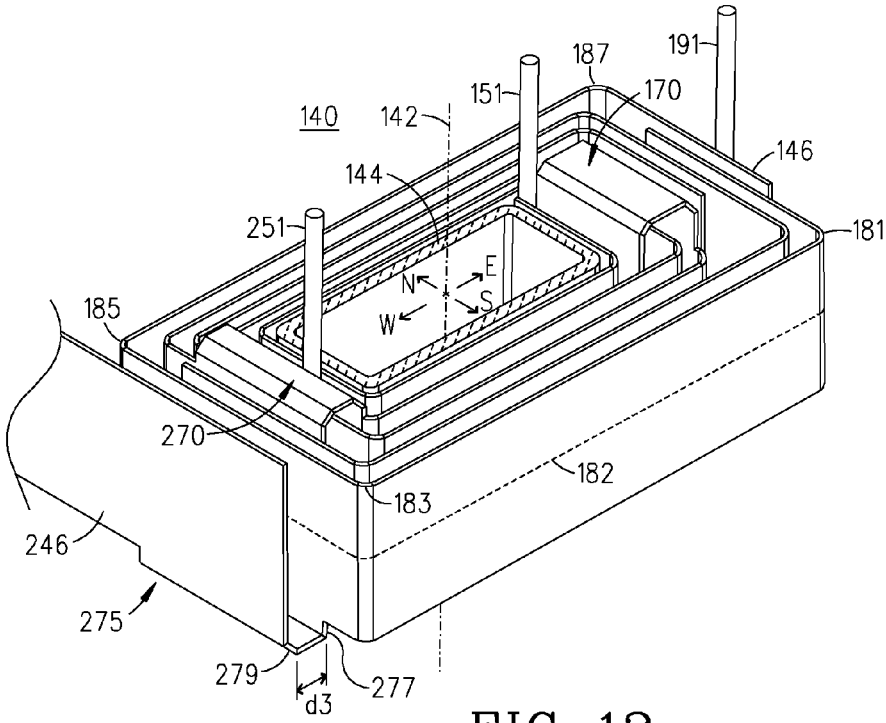
FIG. 12 illustrates a next step in assembling the electrical winding structure illustrated in FIG. 11.

FIG. 12 illustrates a next step in assembling the electrical winding structure illustrated in FIG. 11. In FIG. 12, a transition structure 275 of winding strip 246 includes folding structures 277, 279 separated by a distance $d_3$. Folding structures 277, 279 are flexed or folded to return strip 246 to winding path 182 for applying further winding using strip 246. Distance $d_3$ is of sufficient length to span one or more layers of strip 146 (one layer is illustrated in FIG. 12) and permit proper positioning of strip 246 with respect to winding path 182 for applying new windings in substantially abutting relationship with strip 146 using a new portion of strip 246 (see, e.g., portions 100, 70, 60; strip 32; FIG. 3). Winding of strip 246 about strip 146 is effected in a manner substantially as described in connection with FIGS. 4-11. One skilled in the art of electrical winding structures will recognize the similarities among FIGS. 4-11 and understand their applicability to establishing additional winding by strip 246 about strip 146. In order to avoid prolixity a detailed description will not be repeated here.

Figure 13:
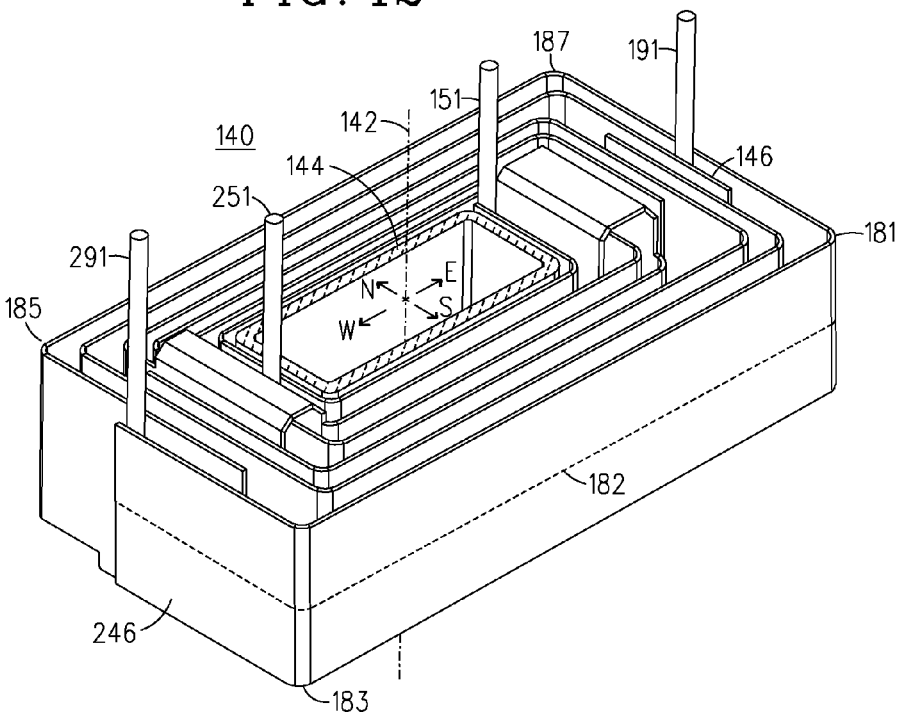
FIG. 13 illustrates a next step in assembling the electrical winding structure illustrated in FIG. 12.

FIG. 13 illustrates a next step in assembling the electrical winding structure illustrated in FIG. 12. In FIG. 13, winding strip 246 proceeds along winding path 182 substantially around electrical winding structure 140 to return to a position between corners 183, 185. More than one layer of strip 246 may be applied, but only one layer is illustrated here. Layers 146, 246 and central member 144 are preferably oriented in substantially abutting relation when electrical winding structure 140 is in its assembled or installed orientation. Loose windings with gaps between layers are illustrated here to aid in understanding the invention. In its winding about strip 146, strip 246 proceeds along winding path 182 past northwest corner 185, northeast corner 187, southeast corner 181 and southwest corner 183 to return to the position illustrated in FIG. 13. Strip 246 has now (FIG. 13) established three turns about electrical winding structure 140. An electrical lead 291 is affixed with strip 246 to establish electrical contact with strip 246. One may observe that strip 246 is electrically continuous along its entire length among various winding layers. Electrical leads 251, 291 electrically terminate each end of strip 246.

Figure 14:
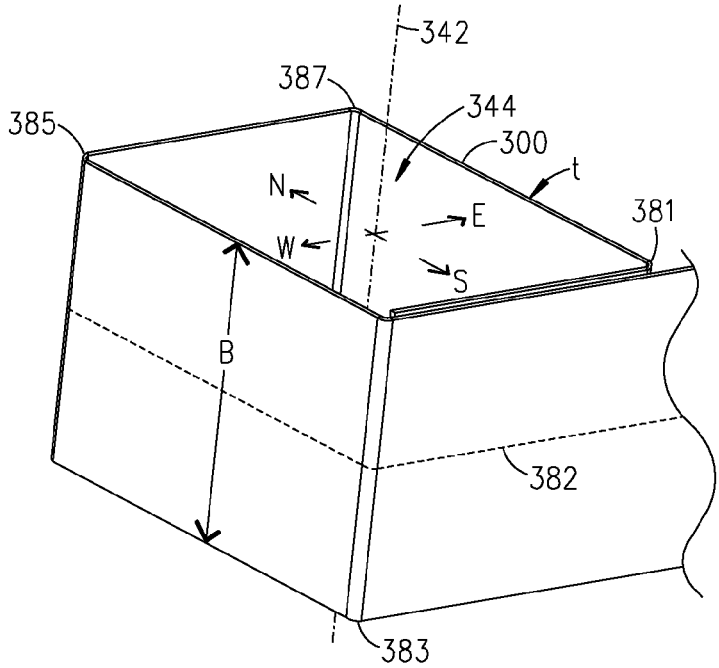
FIG. 14 illustrates a first step in assembling an electrical winding structure according to a second embodiment of the present invention.

FIG. 14 illustrates a first step in assembling an electrical winding structure according to a second embodiment of the present invention. In FIG. 14, a winding strip 300 is wound oriented substantially symmetrically about an axis 342. For ease of reference a plane is illustrated substantially perpendicular with axis 342 having directions "NORTH", "EAST", "SOUTH" and "WEST". Winding strip 300 is wound about a central area 344. Central area 344 may contain a central structure or member (not shown in FIG. 14) substantially symmetrically oriented about axis 342 and configured, by way of example and not by way of limitation, as described in connection with FIG. 4 above. As may be recognized by those skilled in the art of electrical winding structures a central member may be a non-ferrous form for establishing an air core, may be a solid ferrous core member, may be a thin-walled ferrous member or may be a mandrel upon which winding strip 300 is wound, which mandrel may be removed after completion of winding.

Winding strip 300 is configured as a substantially linear strip having a thickness t, a width or breadth B greater than thickness t and a length greater than width B. Length is not indicated in FIG. 14 because length of strip 300 may be as great or as long as is desired to establish a desired number of turns about a central member (not shown in FIG. 14; see FIGS. 4-13). Winding strip 300 is applied along a winding path 382 for establishing windings about central area 344. Strip 300 may be configured similar to one portion 60, 70, 100 of strip 32 (FIG. 3) with fold structures provided to accommodate southeast corner 381, southwest corner 383, northwest corner 385 and northeast corner 387 during winding. If strip 300 is sufficiently thin and flexible no fold structures are requires. By way of example and not by way of limitation, a sufficiently thin winding strip not to require fold structures may have a thickness t of approximately 0.010 inches.

Strip 300 is wound along winding path 382 beginning from about southwest corner 383 and windingly passing corners 381, 387, 385, 383. Strip 300 may continue winding along winding path 382 past corner 381 if more than one turn about central area 344 is desired.

Figure 15:
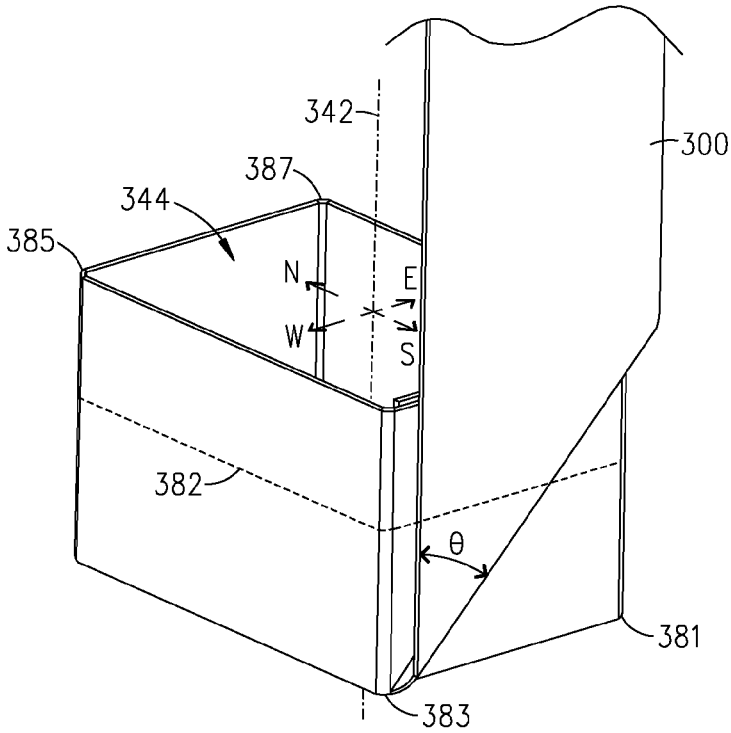
FIG. 15 illustrates a second step in assembling the electrical winding structure illustrated in FIG. 14.

FIG. 15 illustrates a second step in assembling the electrical winding structure illustrated in FIG. 14. The arrangement of central area 344, axis 342 and directions NORTH, EAST, SOUTH and WEST (Abbreviated N, E, S and W in FIGS. 15-19) is similar in FIGS. 14-19. In order to avoid prolixity description of that arrangement will not be repeated in connection with FIGS. 15-19). In FIG. 15, winding strip 300 is arranged to clear winding path 382 so that another strip (not shown in FIGS. 5-19) may be wound over top of winding strip 300. When winding strip 300 is sufficiently thin, no transition structure is required as was described in connection with strip 32 (FIG. 3). By way of example and not by way of limitation, a sufficiently thin winding strip not to require fold structures may have a thickness of approximately 0.010 inches. Strip 300 is foldingly arranged at a folding angle θ to clear winding path 382 for application of another winding strip (not shown). A preferred value for folding angle θ is approximately 45 degrees. However, any angle θ that clears winding path 382 for another strip to be wound over strip 300 is within the intended scope of this invention.

Figure 16:
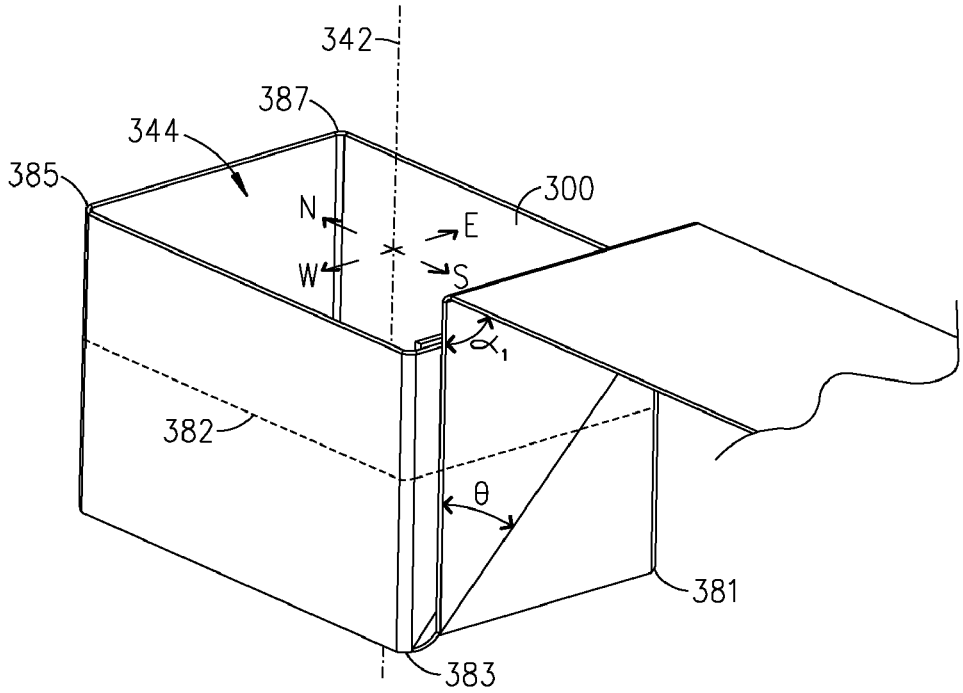
FIG. 16 illustrates a next step in assembling the electrical winding structure illustrated in FIG. 15.

FIG. 16 illustrates a next step in assembling the electrical winding structure illustrated in FIG. 15. In FIG. 16, winding strip 300 is initially positioned for rearranging toward an orientation permitting continuation of winding along winding path 382. Strip 300 is oriented a first return angle $\alpha_1$ to clear a second winding strip (not shown in FIG. 16). A preferred value for first return angle $\alpha_1$ is approximately 90 degrees. However, any first return angle $\alpha_1$ that positions strip 300 for rearranging toward an orientation permitting continuation of winding along winding path 382 is within the intended scope of this invention.

Figure 17:
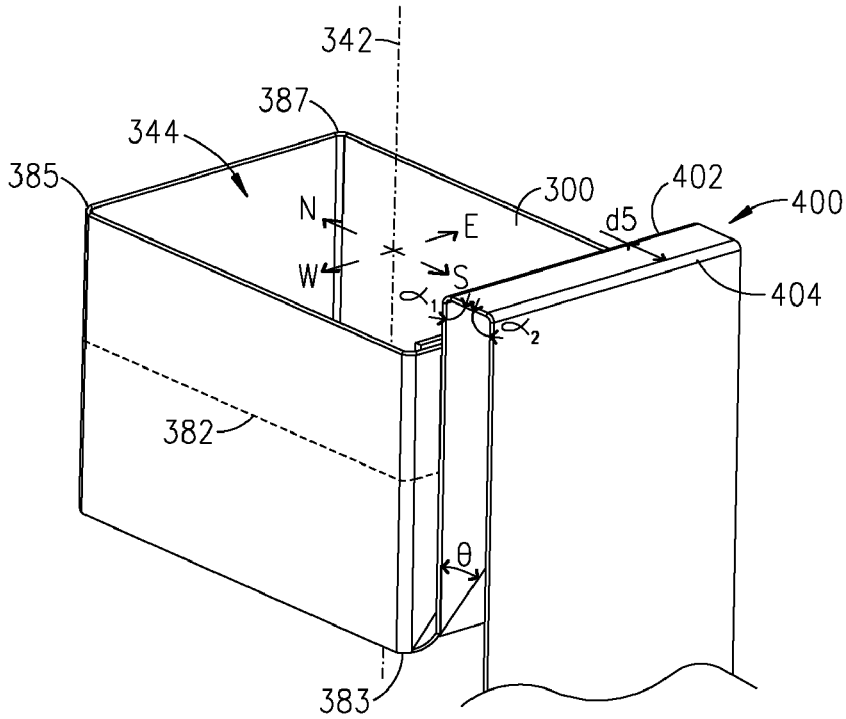
FIG. 17 illustrates a next step in assembling the electrical winding structure illustrated in FIG. 16.

FIG. 17 illustrates a next step in assembling the electrical winding structure illustrated in FIG. 16. In FIG. 17, winding strip 300 is further positioned for rearranging toward an orientation permitting continuation of winding along winding path 382. Strip 300 is oriented a second return angle $\alpha_2$ to further clear a second winding strip (not shown in FIG. 17). FIG. 17 illustrates strip 300 as establishing a transition structure 400 having fold structures 402, 404 separated by a distance $d_5$. Distance $d_5$ is intended to be sufficient to span another winding applied over strip 300 (not shown in FIG. 17). When strip 300 and a second-wound strip wound over top of strip 300 are sufficiently thin, no transition structure 400 need actually be formed in strip 300 for spanning a second-wound strip. By way of example and not by way of limitation, a sufficiently thin winding strip not to require fold structures may have a thickness of approximately 0.010 inches. A preferred value for second return angle $\alpha_2$ is approximately 90 degrees. However, any second return angle $\alpha_2$ that positions strip 300 for rearranging toward an orientation permitting continuation of winding along winding path 382 is within the intended scope of this invention.

Figure 18:
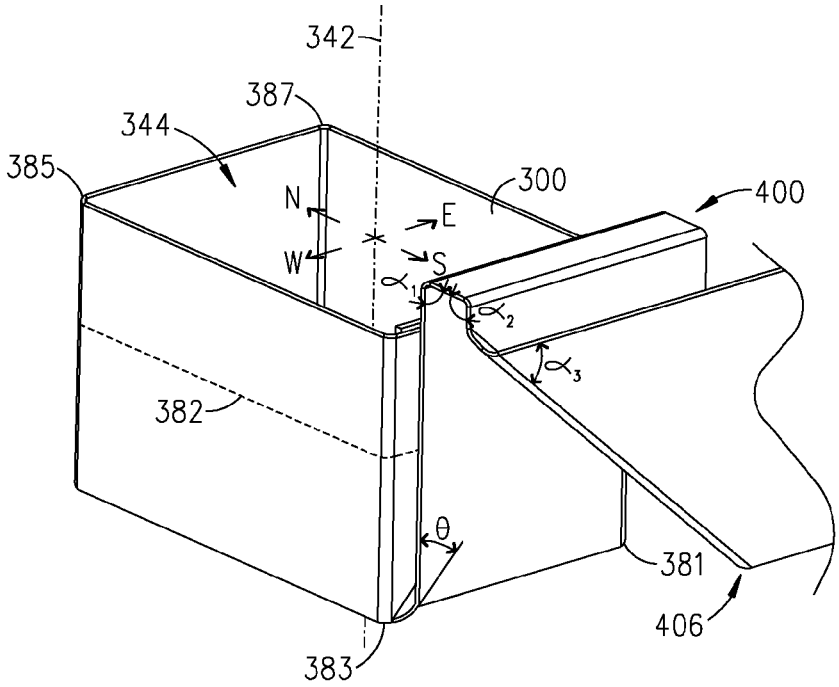
FIG. 18 illustrates a next step in assembling the electrical winding structure illustrated in FIG. 17.

FIG. 18 illustrates a next step in assembling the electrical winding structure illustrated in FIG. 17. In FIG. 18, winding strip 300 is finally positioned for rearranging toward an orientation permitting continuation of winding along winding path 382. Strip 300 is oriented a third return angle $\alpha_3$ to further clear a second winding strip (not shown in FIG. 18). FIG. 18 illustrates strip 300 as establishing a transition structure 406 configured similar to transition structure 400 (FIG. 17) to span another winding applied over strip 300 (not shown in FIG. 18). When strip 300 and a second-wound strip wound over top of strip 300 are sufficiently thin, no transition structure 406 need actually be formed in strip 300 for spanning a second-wound strip. By way of example and not by way of limitation, a sufficiently thin winding strip not to require fold structures may have a thickness of approximately 0.010 inches. A preferred value for third return angle $\alpha_3$ is approximately 45 degrees. However, any third return angle $\alpha_3$ that positions strip 300 for rearranging toward an orientation permitting continuation of winding along winding path 382 is within the intended scope of this invention.

Figure 19:
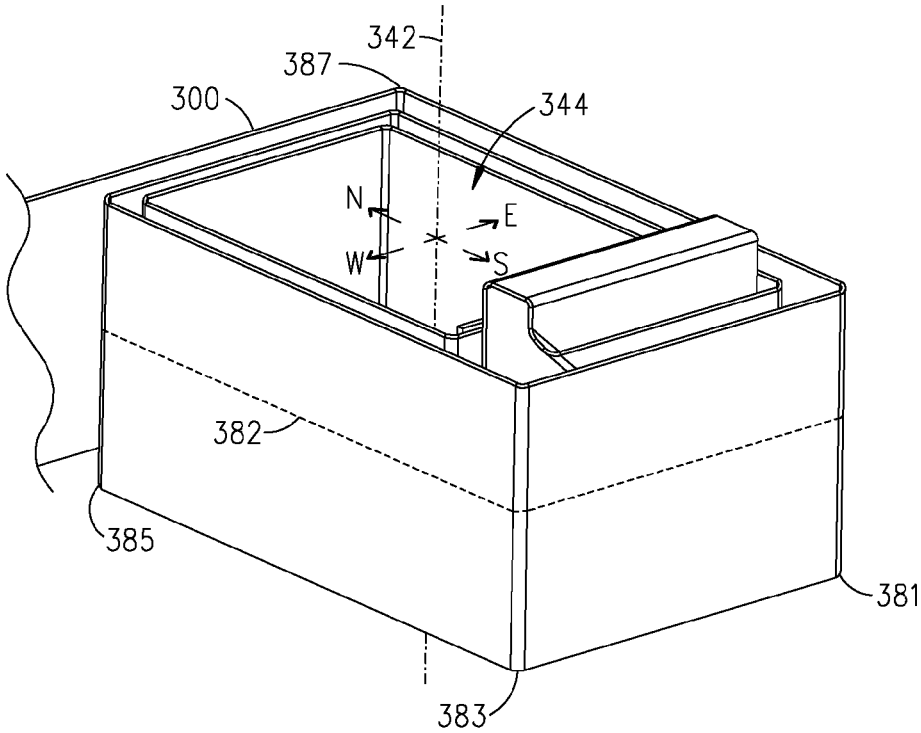
FIG. 19 illustrates a next step in assembling the electrical winding structure illustrated in FIG. 18.

FIG. 19 illustrates a next step in assembling the electrical winding structure illustrated in FIG. 18. In FIG. 19, winding strip 300 is wound along winding path 382 about central area 344 substantially symmetrically about axis 342. Strip 300 is wound along winding path 382 beginning from about southwest corner 383 and windingly passing corners 381, 387, 385. Strip 300 may continue winding along winding path 382 past corner 381 if more than one turn about central area 344 is desired.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. A method for assembling a first electrical winding structure and a second electrical winding structure in an installed orientation about a central member; said central member being generally symmetrical about an axis; each of said first winding structure and said second winding structure being configured in a strip having a thickness, having a width greater than said thickness and having a length greater than said width; said first winding structure and said second winding structure being arranged in a plurality of alternating strata with said widths of said first winding structure and said second winding structure generally parallel with said axis in said installed orientation; the method comprising the steps of:

(a) winding said first winding structure in a winding path about said central member until a first stratum of said plurality of strata is established in said installed orientation;

(b) arranging said first winding structure to clear said winding path;

(c) winding said second winding structure in said winding path about said central member until a next stratum of said plurality of strata is established in said installed orientation;

(d) interleaving said first winding structure and said second winding structure to establish said plurality of strata; said interleaving comprising the steps of:

(1) rearranging a next-to-be-wound said winding structure of said first winding structure and said second winding structure to realign said next-to-be-wound winding structure with said winding path;

(2) winding said next-to-be-wound winding structure in said winding path about said central member until a next stratum of said plurality of strata is established in said installed orientation;

(3) arranging said next-to-be-wound winding structure to clear said winding path; and (4) repeating steps (d)(1) through (d)(3) until said interleaving is complete.

2. A method for assembling a first electrical winding structure and a second electrical winding structure in an installed orientation about a central member as recited in claim 1 wherein adjacent said winding structures in said installed orientation are in substantially abutting relation.

3. A method for assembling a first electrical winding structure and a second electrical winding structure in an installed orientation about a central member as recited in claim 2 wherein adjacent said winding structures in said installed orientation are generally in register.

4. A method for assembling a first electrical winding structure and a second electrical winding structure in an installed orientation about a central member as recited in claim 3 wherein said arranging orients each respective said arranged winding structure with its respective length substantially perpendicular with said winding path.

5. A method for assembling a first electrical winding structure and a second electrical winding structure in an installed orientation about a central member as recited in claim 4 wherein said arranging is effected by a folding of said arranged winding structure.

6. A method for assembling a first electrical winding structure and a second electrical winding structure in an installed orientation about a central member as recited in claim 4 wherein each of said first winding structure and said second winding structure are configured in a unitary segmented strip; first portions of said unitary strip being oriented about a first axis; second portions of said unitary strip being oriented about a second axis substantially perpendicular with said first axis; said first and second portions being oriented to effect said arranging at prearranged loci to establish respective strata of said plurality of strata in said installed orientation.

7. A method for assembling a first electrical winding structure and a second electrical winding structure in an installed orientation about a central member as recited in claim 1 wherein adjacent said winding structures in said installed orientation are generally in register.

8. A method for assembling a first electrical winding structure and a second electrical winding structure in an installed orientation about a central member as recited in claim 1 wherein said arranging orients each respective said arranged winding structure with its respective length substantially perpendicular with said winding path.

9. A method for assembling a first electrical winding structure and a second electrical winding structure in an installed orientation about a central member as recited in claim 8 wherein said arranging is effected by a folding of said arranged winding structure.

10. A method for assembling a first electrical winding structure and a second electrical winding structure in an installed orientation about a central member as recited in claim 8 wherein each of said first winding structure and said second winding structure are configured in a unitary segmented strip; first portions of said unitary strip being oriented about a first axis; second portions of said unitary strip being oriented about a second axis substantially perpendicular with said first axis; said first and second portions being oriented to effect said arranging at prearranged loci to establish respective strata of said plurality of strata in said installed orientation.

11. A method for assembling a plurality of electrical winding structures in an installed orientation about a central member; said central member being generally symmetrical about an axis; each respective winding structure of said plurality of winding structures being configured in a strip having a thickness, having a width greater than said thickness and having a length greater than said width; said plurality of winding structures being arranged in a plurality of alternating strata with said widths of each said respective winding structure generally parallel with said axis in said installed orientation; the method comprising the steps of:

(a) winding a first winding structure of said plurality of winding structures to establish a first-wound winding structure in a winding path about said central member until a first stratum of said plurality of strata is established in said installed orientation;

(b) arranging said first-wound winding structure to clear said winding path;

(c) winding one or more next winding structures of said plurality of winding structures to establish one or more next-wound winding structures in said winding path about said central member until at least one next stratum of said plurality of strata is established in said installed orientation; and (d) interleaving earlier-wound said winding structures to establish said plurality of strata; said interleaving comprising the steps of:

(1) rearranging a next-to-be-wound said winding structure of said wound winding structures to realign said next-to-be-wound winding structure with said winding path;

(2) winding said next-to-be-wound winding structure in said winding path about said central member until a next stratum of said plurality of strata is established in said installed orientation;

(3) arranging said next-to-be-wound winding structure to clear said winding path; and (4) repeating steps (d)(1) through (d)(3) until said interleaving is complete.

12. A method for assembling a plurality of electrical winding structures in an installed orientation about a central member as recited in claim 11 wherein adjacent said winding structures in said installed orientation are in substantially abutting relation.

13. A method for assembling a plurality of electrical winding structures in an installed orientation about a central member as recited in claim 11 wherein adjacent said winding structures in said installed orientation are generally in register.

14. A method for assembling a plurality of electrical winding structures in an installed orientation about a central member as recited in claim 11 wherein said arranging orients each respective said arranged winding structure with its respective length substantially perpendicular with said winding path.

15. A method for assembling a plurality of electrical winding structures in an installed orientation about a central member as recited in claim 14 wherein said arranging is effected by a folding of said arranged winding structure.

16. A method for assembling a plurality of electrical winding structures in an installed orientation about a central member as recited in claim 14 wherein each said respective winding structure is configured in a unitary segmented strip; first portions of said unitary strip being oriented about a first axis; second portions of said unitary strip being oriented about a second axis substantially perpendicular with said first axis; said first and second portions being oriented to effect said arranging at prearranged loci to establish respective strata of said plurality of strata in said installed orientation.

* * * * *